US006270050B1

(12) United States Patent
Friedrich

(10) Patent No.: US 6,270,050 B1
(45) Date of Patent: Aug. 7, 2001

(54) PILLOW MOUNTED BOOK HOLDER

(76) Inventor: David L. Friedrich, 2051 Hamill Rd., Suite 210, Hixson, TN (US) 37343

( * ) Notice: Subject to any disclaimer, the term of this patent is extended or adjusted under 35 U.S.C. 154(b) by 0 days.

(21) Appl. No.: 09/478,834

(22) Filed: Jan. 6, 2000

Related U.S. Application Data

(60) Provisional application No. 60/121,821, filed on Feb. 24, 1999.

(51) Int. Cl.[7] ..... A47B 97/04

(52) U.S. Cl. ..... 248/444; 5/639

(58) Field of Search ..... 248/444, 451, 248/453, 316.1, 316.8; 5/636, 639

(56) References Cited

U.S. PATENT DOCUMENTS 1,928,806 * 10/1933 Barcalo ..... 5/639
1,934,254 * 11/1933 Barcalo ..... 5/639
4,537,646 * 8/1985 Hoyle ..... 156/212
4,771,977 * 9/1988 Larson ..... 248/460

* cited by examiner

*Primary Examiner*—Anita M. King
*Assistant Examiner*—Holly N. Sy
(74) *Attorney, Agent, or Firm*—Alan Ruderman; Miller & Martin LLP

(57) ABSTRACT

A pillow carrying book holder includes a frame in the form of a plate within the pillow. The plate supports retraction mechanism which is connected externally of the pillow to a pair of book engaging fingers. The retraction mechanism includes a pair of springs having one end mounted within the pillow and the other end secured to the book engaging fingers. A housing within the pillow encloses the retraction mechanism within the pillow and separated it from filler material within the pillow. The filler material may include freely moveable particulate for conforming the pillow to the shape of the surface on which the pillow is positioned.

7 Claims, 1 Drawing Sheet

PILLOW MOUNTED BOOK HOLDER

This Application claims benefit of Provisional Application Ser. No. 60/121,821 filed Feb. 24, 1999.

BACKGROUND OF THE INVENTION

This invention relates to a pillow carrying book holder or a book holder carried by a pillow which may readily rest on the lap of a user and easily hold a book in a desired reading position.

Book holders used for retaining and positioning a book for reading without requiring the reader to hold the book are well known. There are various designs and constructions which are positionable and rest upon a table or other flat surface. One known construction of this type comprises metal rods which connect together and have certain of the rods which fold to engage a book and to fold to a stored position. Another such construction illustrated in U.S. Pat. No. 4,123,029 comprises a wooden face plate with a triangular support plate on the back and having a shelf on the front on which a book may rest, it having spring biased fingers to engage and hold the book.

Other constructions permit a book to be held by the reader while in a sitting or prone position. Examples of such book holders are illustrated in U.S. Pat. Nos. 1,029,668; 2,481,107 and 4,356,991. However, each of these book holder are awkward to use and when used is relatively unstable and uncomfortable. Another apparatus which may be used to support a book and which may be used either resting on a table or positioned on the lap of a user is illustrated in U.S. Pat. No. 5,114,110, this structure being a board with a flexible support or base and an elastic cord for holding the book.

It is highly desirable and would be extremely useful if a book holder were constructed to rest comfortably on the lap of a user and yet be stable. It is know to provide a board in a stuffed bag forming a portable lap desk, see for example U.S. Pat. No. 4,537,646 . However, no such simple comfortable book holder is known to have been proposed in the prior art.

SUMMARY OF THE INVENTION

Consequently, it is a primary object of the present invention to provide a book holder that may rest comfortably on the lap of a user while in a sitting or prone position.

It is another object of the present invention to provide a book holder that is connected to a pillow permitting the book holder to be disposed on the lap of a user with the pillow comfortably on the lap of the user.

It is a further object of the present invention to provide a book holder in combination with a pillow, the book holder having a frame disposed within the interior of the pillow and having book engaging fingers disposed on the exterior of the pillow and biased toward the frame.

Accordingly, the present invention provides a pillow carrying book holder structure including a frame in the form of a board positioned within the pillow, the board supporting retraction mechanism which is connected to a pair of book engaging fingers, the fingers being externally of the pillow and biased by the retraction mechanism toward the frame. Thus, a book may be positioned on the pillow in juxtaposition with the board and held by the fingers as they are retracted toward the pillow and the frame. The pillow may be filled with conventional stuffing material and may include a freely movable particulate filling comprising a multiplicity of small balls or other particles such as used in a "bean bag" so that the pillow will conform to the lap of a user. Thus, the pillow mounted book holder may comfortably be positioned for use when the reader or user is sitting, resting or prone.

BRIEF DESCRIPTION OF THE DRAWINGS

The particular features and advantages of the invention of the invention as well as other objects will become apparent from the following description taken in connection with the accompanying drawings in which.

DESCRIPTION OF THE PREFERRED EMBODIMENT

Figure 1:
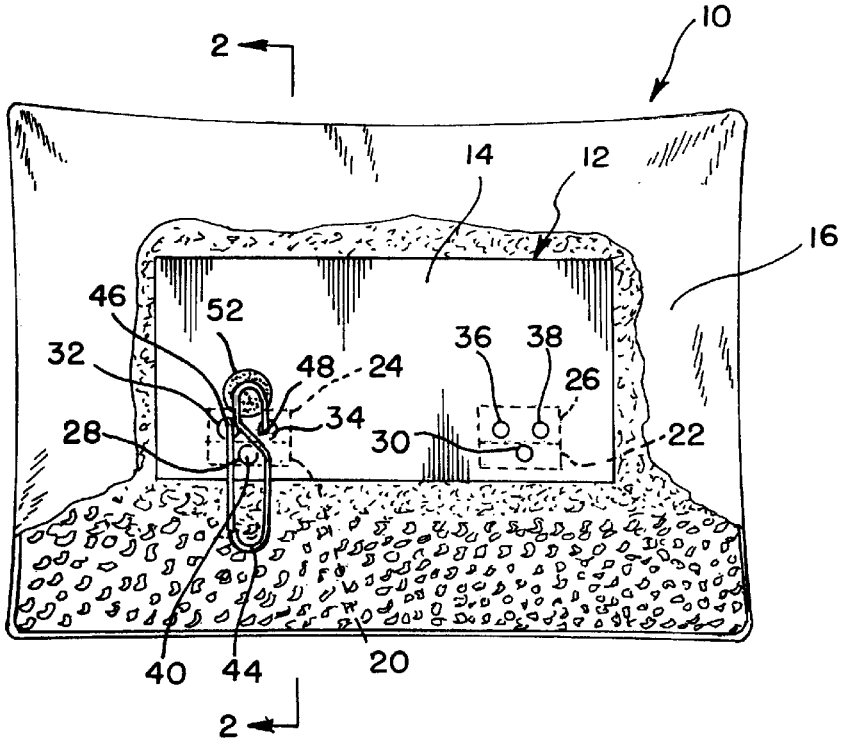
FIG. 1 is a front elevational view of a pillow mounted book holder constructed in accordance with the present invention, partly broken away and with parts thereof removed for purposes of clarity.
Figure 2:
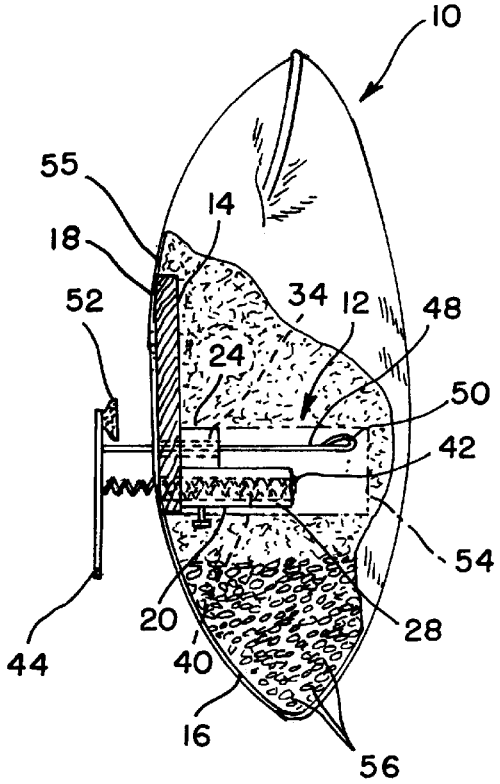
FIG. 2 is a sectional view taken along line 2—2 of FIG. 1 illustrating the book holding and retraction mechanism.

Referring now to the drawings, FIG. 1 illustrates a throw pillow 10 within which is mounted a book holding structure 12 constructed in accordance with the present invention. The book holding structure comprises a frame 14 defined by a plate or other structure preferably formed from wood and which may have a substantially rectangular configuration. The front surface of the frame 14 may be attached as by glue to the interior of the ticking or covering 16 of the pillow as illustrated at 18 while a pair of spaced apart blocks 20, 22 are glued to or otherwise secured to the rear surface of the frame 14 adjacent the lower edge of the frame. A small pair of blocks 24, 26 may be secured to the frame above the blocks 20, 22 respectively, or may be formed together with the respective block 20, 22. Formed through the frame 14 and each of the blocks 20, 22 is a first aperture or bore 28, 30 respectively. Additionally, there may be two apertures 32, 34 and 36, 38 formed respectively through each of the blocks, the apertures being substantially parallel bores, all for purposes which will hereinafter become clear.

Extending through each block 20 and 22 is a respective extension spring 40, only one of which is illustrated, one end of each spring being secured to the rear of the respective block 20, 22 such as at 42. The other end of each spring 40 extends through the ticking 16 and is fastened to a user graspable finger 44 which may be in the form of a wire or rod bent so that respective ends may overlay the apertures 32, 34 and 36, 38 respectively. A rod 46, 48 extends through each respective hole or aperture 32, 34 while a similar pair of rods (not illustrated) extends through the holes 36, 38, and the outer end of each rod is fastened to the respective end of the bent rod 44 overlaying the holes 32, 34 and 36, 38. The opposite end of each rod may be bent or otherwise formed so as to have a stop 50 formed thereon as illustrated in regard to the rod 48. A felt pad 52 or the like may be bonded to each bent rod 44 intermediate the connection with the respective pair of elongated rods 46, 48. Thus, the felt pad 52 may abut the open pages of a book resting on the sets of rods 46, 48 after the fingers 44 have been pulled to position the book and the open pages.

Positioned about the retractor mechanism and secured to the rear of the frame 14 may be a housing 54 preferably constructed from sheet metal and covered with plastic or form rubber. Thus, filler material 55 such as polyester or the like will not interfere with the operation of the retractor mechanism. Additionally, in order to provide stability and permit the pillow to conform to the lap of the user, particulate 56 comprising free flowing solid material such as small balls or beans which are used in "bean bags" may be located within the pillow at the bottom thereof below the polyester fill material. Thus, the pillow may be placed on the lap of the user, positioned comfortably and a book held thereon.

Accordingly, there is herein disclosed a pillow having a book holder for use when one is reading and prefers to rest comfortably without manually holding the book.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed therein is:

1. A book holder for holding a book in an open position, comprising: a pillow having a ticking with filler material therein, a plate mounted in said pillow, said plate having a front face abutting said ticking and a rear face, a book support extending through said plate and said ticking and moveable relatively to said plate and said ticking, at least one spring loaded page gripping assembly secured to said book support externally of said pillow, and a spring having one end fixed within said pillow and one end secured to the page gripping assembly for pulling said assembly toward said ticking.

2. A book holder for holding a book as recited in claim 1, wherein said book support is substantially perpendicular to said plate.

3. A book holder for holding a book as recited in claim 1, including a housing within said pillow for enclosing the spring and book support within said pillow to separate the spring and book support from the filler material.

4. A book holder for holding a book in an open position, comprising: a pillow having a covering and filler material therein a plate positioned within said pillow; a book resting structure disposed substantially perpendicular to said plate and extending through the covering of said pillow, a pair of spring biased page gripping assemblies connected to said structure for releasably gripping a pair of adjacent pages of an open book, each page gripping assembly including a rod extending through said plate and said covering, and springs for drawing said page gripping assemblies toward said plate.

5. A book holder for holding a book as recited in claim 4, including a housing within said pillow enclosing said structure, rods and springs and separating them from the filler material.

6. A book holder for holding a book in an open position with a pair of pages disposed side by side, said book holder comprising: a pillow having a ticking with filler material therein, a frame positioned within the ticking of said pillow, book supporting members carried by said frame and extending through said ticking from the interior to the exterior of said pillow, retraction mechanism supported by said frame and extending through said ticking to the exterior of said pillow, and a pair of book engaging fingers disposed at the exterior of said pillow and secured to said retention mechanism to be drawn toward said ticking and said frame and for engaging respective pages of said pair of pages.

7. A book holder as recited in claim 6, including a housing enclosing said book supporting members and said retraction mechanism within said pillow.

* * * * *